United States Patent [19]

Cardellini

[11] 4,355,916

[45] Oct. 26, 1982

[54] LOOSE LEAF BINDER

[76] Inventor: Claudio B. Cardellini, Rua Manuel Maria Tourinho, 673, 01236 Sao Paulo SP, Brazil

[21] Appl. No.: 151,887

[22] Filed: May 20, 1980

[30] Foreign Application Priority Data

May 22, 1979 [BR] Brazil ..... 7903221

[51] Int. Cl.[3] ..... B42F 3/04; B42F 13/20

[52] U.S. Cl. ..... 402/41; 402/31

[58] Field of Search ..... 402/26, 29, 30, 31, 402/41, 80 R

[56] References Cited

U.S. PATENT DOCUMENTS

| | | | |
|---|---|---|---|
| 1,398,388 | 11/1921 | Murphy | 402/41 X |
| 2,548,618 | 4/1951 | Purvis | 402/55 |
| 2,888,934 | 6/1959 | Segal | 402/41 |
| 2,924,221 | 2/1960 | Dudley-Smith | 402/26 |

FOREIGN PATENT DOCUMENTS

| | | | |
|---|---|---|---|
| 1409251 | 6/1965 | France | 402/31 |

*Primary Examiner*—Paul A. Bell
*Assistant Examiner*—John S. Brown
*Attorney, Agent, or Firm*—Cushman, Darby & Cushman

[57] ABSTRACT

The present loose leaf binder consists of two main sections each provided with spaced half rings and held together by means of metal links or a length of suitably bent metal wire. Between the two main sections of the binder there is an elongated strip selectively movable to open and close complementary pairs of the binder half rings. The free ends of the complementary pairs of half rings are duly fitted with protruding extensions which overlap when the binder is closed.

6 Claims, 5 Drawing Figures

LOOSE LEAF BINDER

This invention relates to a loose leaf binder which permits leaves to be inserted or removed in a simple, quick manner, In the drawings attached hereto:

The binder consists of two elongated strips 1 and 2 extending in parallel relationship when the binder is closed, the strips being provided with a plurality of correspondingly spaced half rings 3 and 4 into which perforated leaves can be inserted.

Figure 3:
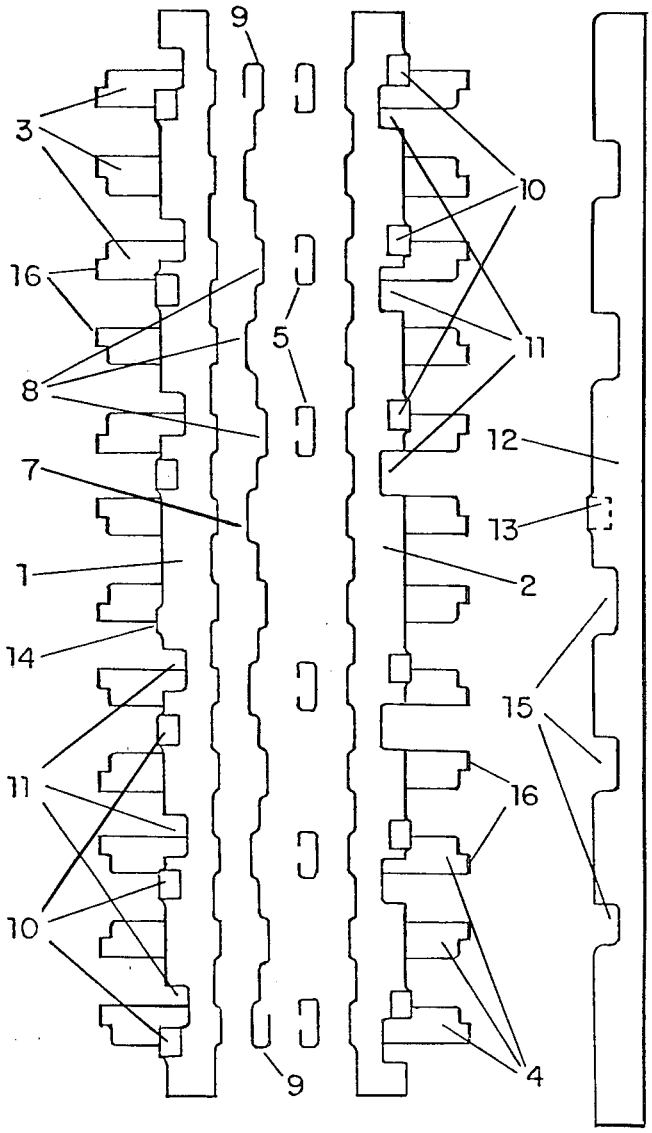
FIG. 3 is an exploded view illustrating the components of the binder.
Figure 4:
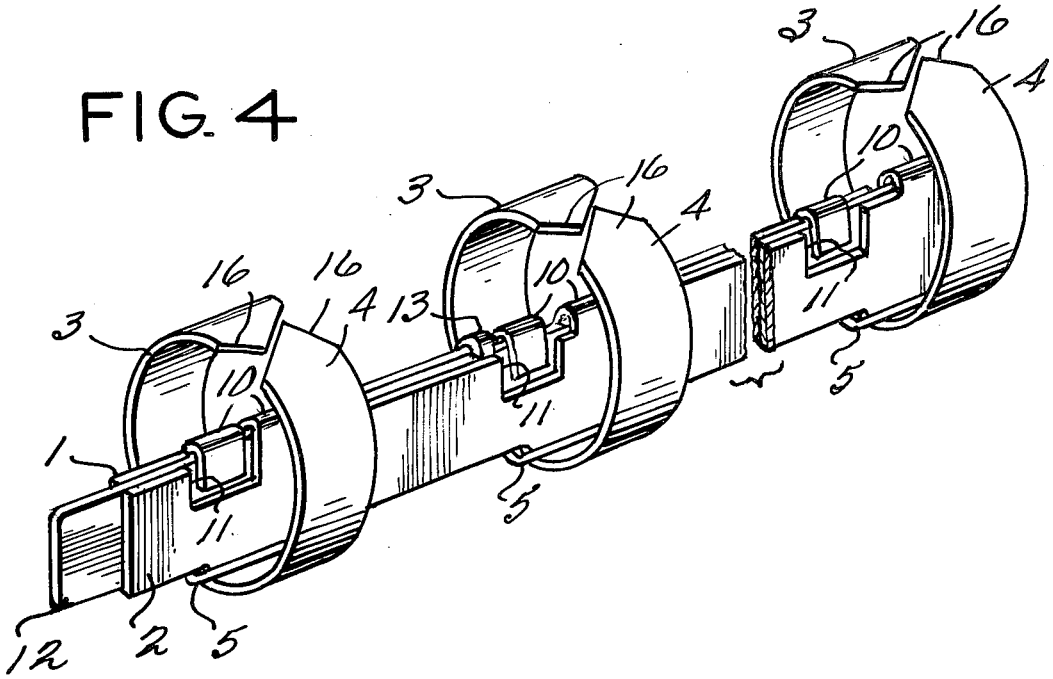
FIGS. 4 and 5 are perspective views of portions of the binder shown in closed and open positions, respectively.
Figure 5:
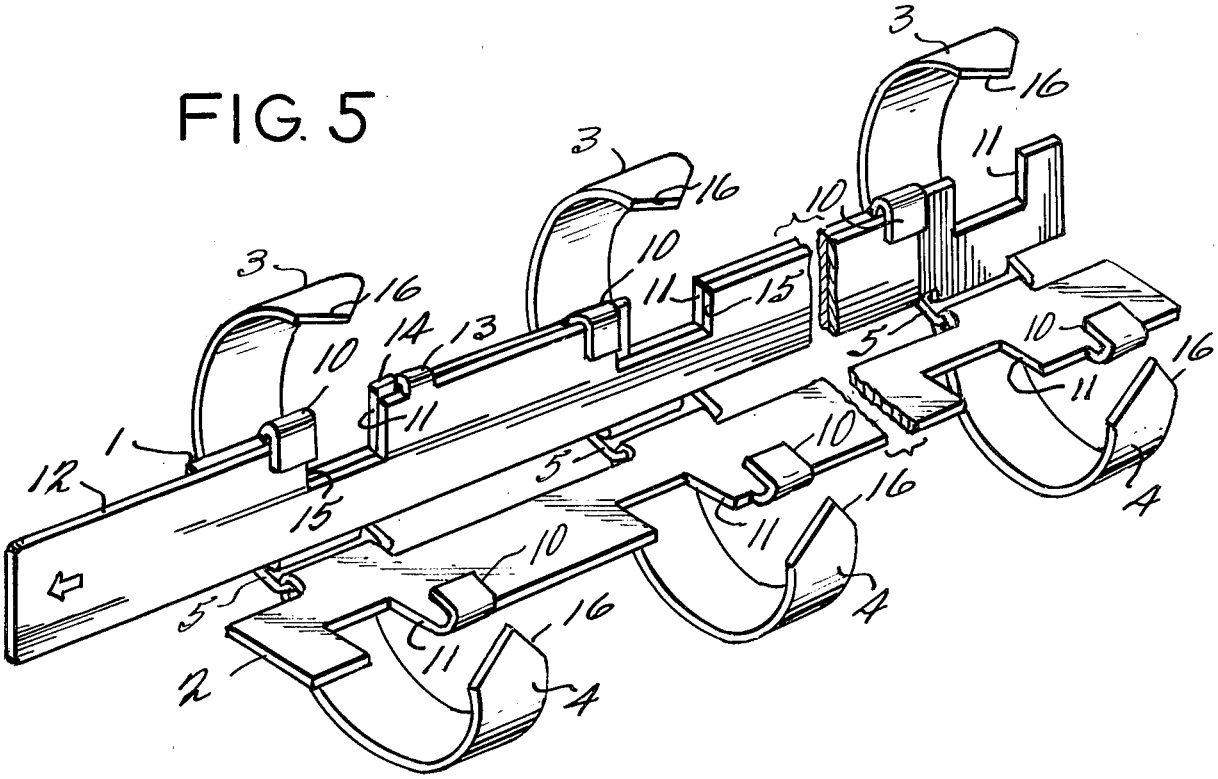

Strips 1 and 2 are joined by means of links 5 of metallic wire connecting each, or at least some of, the pairs of complementary half rings of the binder. This can best be appreciated by reference to FIGS. 4 and 5. Each link loosely "embraces" the lower parts of the pair of complementary half rings. Alternatively, strips 1 and 2 can be linked together by means of an elongated wire 7 of metal or any other adequate material (FIG. 3). The wire 7 is bent along its length in such a way that the wire weaves together in an alternating fashion the half rings on strip 1 and the half rings on strip 2. The ends of wire 7 are bent 180° so as to loosely hold together the lower parts of the first and last pairs of complementary half rings.

Strips 1 and 2 are provided at their upper edges with a plurality of spaced 180° folds 10 located adjacent a series of spaced recesses or slots 11 in the respective strip. As can be appreciated from FIGS. 3 and 4, when the binder is closed, each of the folds 10 in strip 1 fits into the corresponding slot 11 in strip 2. Likewise, each fold 10 of strip 2 fits into its corresponding slot 11 in strip 1. Between strips 1 and 2 there is positioned a device for opening and closing the binder. This device comprises an elongated strip 12 which is somewhat longer than strips 1 and 2 and which has an edge inserted into the folds 10 of strip 1 thus securing strip 12 to strip 1 while at the same time permitting strip 12 to move longitudinally in relation to strip 1.

In order to limit the longitudinal movement of strip 12, as well as to prevent it from detaching itself from strip 1 when the binder is open, strip 12 includes at its upper edge one or more 180° folds 13 within which strip 1 is inserted. Each fold 13 is located between a small projection 14 on the upper edge of strip 1 and a fold 10 on this strip.

Strip 12 also is provided along its upper edge with a series of slots 15 shaped and arranged in such a way that, depending on the position of strip 12 in relation to strip 1, slots 15 either cover or uncover slots 11 of strip 1.

The binder will stay closed whenever the major surfaces of strips 1 and 2 are brought together and strip 12 is positioned to cover the slots 11 of strip 1. In such a condition, the strip 12 retains folds 10 of strip 2 thereby preventing half rings 3 and 4 from separating. To open the binder strip 12 is moved to a position where its slots 15 uncover slots 11 of strip 1. In this position, folds 10 of strip 2 are released from strip 12, and the half rings 3 can be moved away from half rings 4, thereby permitting one to insert or remove leaves from the binder.

To close the binder the procedure just described is reversed, i.e. half rings 3 and 4 are moved together and strip 12 is slid back to its original position. The penetration of strip 12 into folds 10 of strip 2 when the binder is being closed must be effected gradually, starting such an operation at folds 10 at the ends of strip 2. Therefore, the widths of slots 15 must be greatest at the middle of strip 12, and they gradually decrease toward the ends of strip 12.

Figure 1:
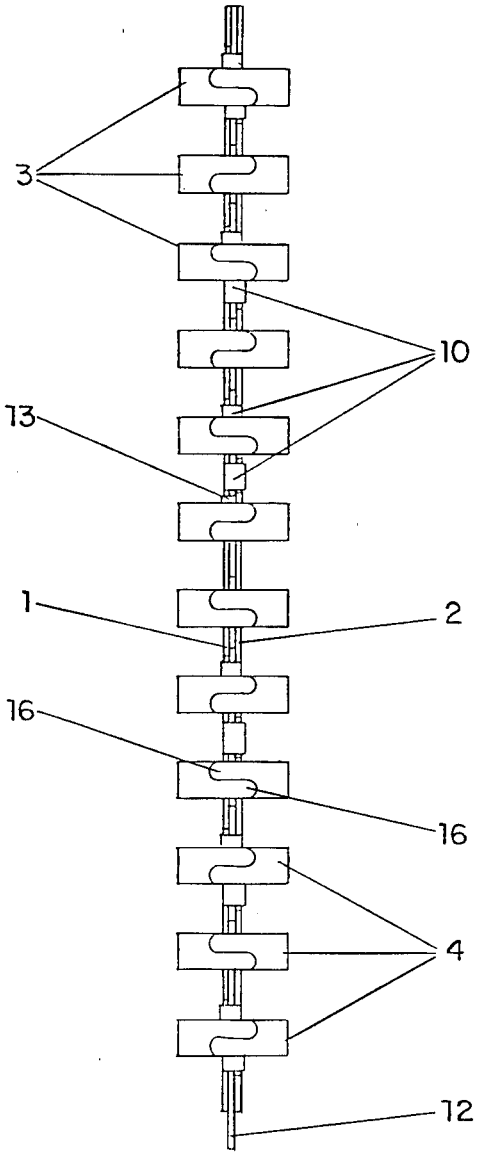
FIG. 1 is a top plan view of the binder in the closed position.
Figure 2:
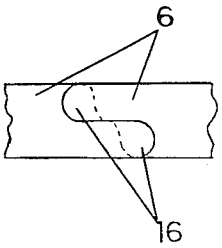
FIG. 2 is a detailed view of portions of two complementary half rings in the closed position.

Each half ring 3 and 4 features at its free end an offset jutting extension 16 so that for each pair of complementary half rings, the protruding extension 16 of one half ring overlaps the other half ring, as shown in FIG. 2.

What I claim is:

1. A loose leaf binder comprising:

a pair of elongated strips each having a plurality of half rings at corresponding spaced locations along an edge thereof;

means hingedly interconnecting said strips;

means provided at the ends of said half rings to permit a half ring associated with one strip to cooperate with a half ring associated with the other strip to form a full ring when the half rings are positioned in juxtaposition;

means provided on said first strip for retaining a third elongated strip while permitting relative longitudinal movement therebetween, said third strip being interposed between the first and second strips when the half rings are in juxtaposition;

a plurality of folds provided along one longitudinal edge of said second strip, said folds being spaced to correspond with spacings of a plurality of slots provided along longitudinal edges of said first and third strip whereby when the half rings are in juxtaposition, said folds are received within the slots in said first strip and said third strip is movable between a first position wherein its longitudinal edge is received within said folds to retain the half rings in juxtaposition and a second position wherein the slots in the third strip are in alignment with the folds so as to permit the first and second strips to be pivoted about their hinged interconnection to move the half rings out of juxtaposition.

2. A loose leaf binder as set forth in claim 1, wherein said means provided on the first strip for retaining the third strip comprises a plurality of additional folds spaced along said longitudinal edge of the first strip and within which the longitudinal edge of the third strip is received.

3. A loose leaf binder as set forth in claim 2, further comprising a plurality of slots provided along said longitudinal edge of the second strip at spaced locations corresponding to the spacings of the additional folds whereby said additional folds are received within the slots in the second strip when the half rings are in juxtaposition.

4. A loose leaf binder as set forth in any of claims 1, 2 or 3 wherein the ends of said half rings include offset extensions whereby when the half rings are in juxtaposition, the extension of each half ring overlaps the other half ring.

5. A loose leaf binder as set forth in any of claims 1, 2 or 3 wherein the widths of the slots in said third strip increase as the slots progress from the ends of the strip towards the center thereof.

6. A loose leaf binder as set forth in any of claims 1, 2 or 3 further comprising means to limit the relative longitudinal movement of said first and third strips.

* * * * *